United States Patent [19]

Nilsson et al.

[11] Patent Number: 4,871,013

[45] Date of Patent: Oct. 3, 1989

[54] DEVICE TO PREVENT THROUGH-FLOW OF A PORT IN A PLATE HEAT EXCHANGER

[75] Inventors: Bo G. Nilsson; Torgny Andersson, both of Kävlinge, Sweden

[73] Assignee: Alfa-Laval Thermal, AB, Tumba, Sweden

[21] Appl. No.: 238,344

[22] PCT Filed: Jan. 18, 1988

[86] PCT No.: PCT/SE88/00008

§ 371 Date: Aug. 30, 1988

§ 102(e) Date: Aug. 30, 1988

[87] PCT Pub. No.: WO88/05894

PCT Pub. Date: Aug. 11, 1988

[30] Foreign Application Priority Data

Feb. 4, 1987 [SE] Sweden ..... 8700419

[51] Int. Cl.[4] ..... F28F 9/00

[52] U.S. Cl. ..... 165/75; 165/167

[58] Field of Search ..... 165/72, 75, 166, 167

[56] References Cited

U.S. PATENT DOCUMENTS 4,387,765 6/1983 Kristoffersson ..... 165/166

FOREIGN PATENT DOCUMENTS 1207016 9/1970 United Kingdom .

1522369 8/1978 United Kingdom .

WO84/00060 1/1984 World Int. Prop. O. .

*Primary Examiner*—Alan Cohan

*Attorney, Agent, or Firm*—Davis Hoxie Faithfull & Hapgood

[57] ABSTRACT

The present invention relates to a plate heat exchanger comprising several heat exchange plates arranged between two end plates (30), at least one of which has through-ports (31) and a side surface (36) facing the heat exchange plates, which is unmachined around the ports (31). At least one of said ports is provided with a cover (32) preventing through-flow. According to the invention said cover (32) is applied against the side surface (36) of the end plate (30) facing the heat exchange plate, and comprises at least two cooperating parts, a first thin part (33) abutting said side surface (36) and a second thick part (35) mainly placed within and essentially covering said port (31). Said first part (33) is dimensioned to withstand shearing forces and said second part (35) is dimensioned to withstand bending forces acting on the cover (32) as a result of an internal pressure in the plate heat exchanger.

3 Claims, 1 Drawing Sheet

DEVICE TO PREVENT THROUGH-FLOW OF A PORT IN A PLATE HEAT EXCHANGER

The present invention relates to a plate heat exchanger comprising several heat exchange plates arranged between two end plates, at least one of which has through-ports and a side surface facing the heat exchange plates and beingunmachined around the ports, at least oen of said ports being provided with a cover preventing through-flow. The expression "unmachined" is intended to mean that the end plate in question has no conventional recesses around the ports for housing of, as an example, gaskets, linings or closing devices when the ports should be closed.

It is previously known to prevent through-flow of a port in a plate heat exchanger. As an example, a recess of the above mentioned kind can be used to house a relatively thick plate covering the port.

Lately new types of end plates have been developed, however, which are unmachined around the ports and thus have no recesses of the above mentioed kind. It has in these cases been regarded as impossible to cover a port by means of a thick plate on the inside of the end plate, as an adjacent heat exchange plate would then loose an essential part of its support against the end plate. It has also been considered too expensive to machine the end plate around the port to provide a recess for such a thick plate. Instead, a body filling out the port has been placed therein and fixed by means of a relatively thick plate covering the port at the outside of the end plate. The disadvantages of this are that it requires machining of the one side of the end plate and special working moments to fasten the plate. Further, said body increases the total weight of the plate heat exchanger, and production and handling of the body means an undesired expense.

The object of the present invention is to eliminate the problems existing with the above described known technqiue and to provide a device which at a low cost and in a simple manner makes it possible to prevent through-flow of ports in unmachined end plates.

This is achieved according to the invention in a plate heat exchanger of the initially described kind, which mainly is characterized in that said cover is applied aginst the side surface of the end plate facing the heat exchange plates, and comprises at least two cooperating parts, a first thin part abutting said side surface and a second thick part mainly placed within and essentially covering said port, said first part being dimensioned to withstand shearing forces, and said second part being dimensioed to withstand bending forces acting on the cover as a result of an internal pressure in the plate heat exchanger.

By the present invention it has thus proved possible to provide an end plate, which is unmachined around the ports, with a cover applied from the inside of the plate heat exchanger, in order to prevent through-flow of a port. The cover is cheap to produce and simple to apply.

Figure 1:
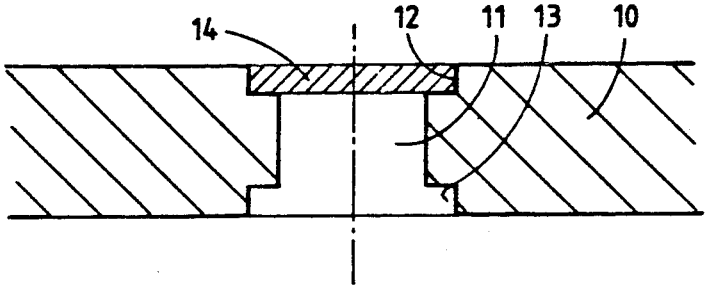
Figure 2:
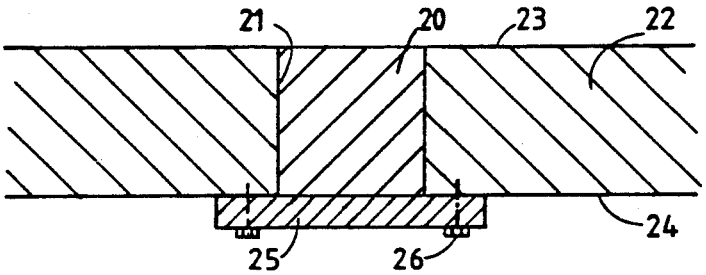

The invention will be described more in detail in the following with reference to the accompanied drawings in which FIGS. 1 and 2 are cross section views of parts of end plates, each comprising a port being covered by a cover according to prior art technique.

Figure 3:
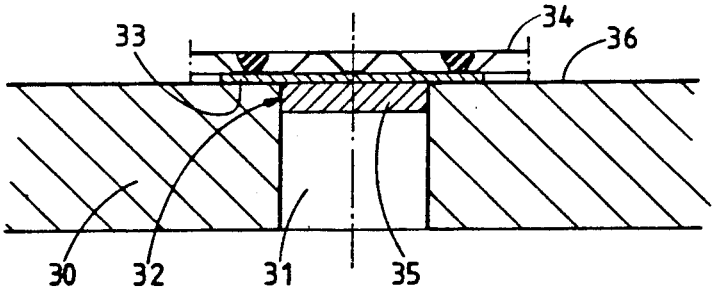
Figure 4:
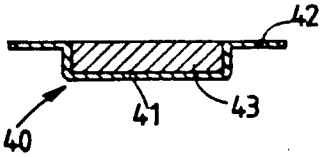
Figure 5:
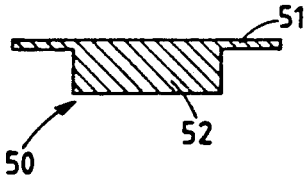
Figure 6:
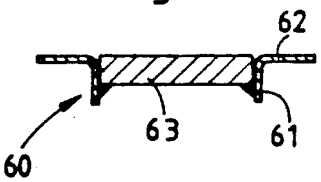

FIG. 3 is a cross section view of a part of an end plate comprising a port covered by a cover in accordance with the present invention, and FIGS. 4–6 are cross section views of three alternative embodiments of a cover in accordance with the present invention.

According to FIG. 1 an end plate 10 is provided with a port 11, extending through the plate, and with recesses 12, 13 in both side surfaces of the plate at the area of the port. Such recesses have previously been ordinary for end plates, at least when a corrosive medium has flowed through the heat exchanger and it has been necessary to provide the ports with linings to protect the end plate against the corrosive medium. In case that the heat exchange medium should not flow through a port 11, a reltively thick plate 14 is applied in the recess 13 at the side surface of the end plate 10 facing a heat exchange plate to cover the port 11 in question. The plate 14 is thick enough to withstand serious bending of plate, even if an internal pressure in the heat exchanger is high. Further, the thickness of the plate 14 corresponds to the depth of the recess, so that the outer surface of the plate is in level with the side surface of the end plate.

According to FIG. 2 a body 20 is placed within a port 21 of an end plate 22, which is unmachind around the port 21. The body 20 fills out essentially the entire port 21, so that it is mainly in level with the side surface 23 of the end plate 22, facing an adjacent heat exchange plate. On the opposite side 24 of the end plate 22 there is a cover plate 25 which is fastened against the end plate 22 by means of bolts 26 to prevent that the body 20 slides out as a result of the forces coming up from the prssure of the medium in the heat exchanger.

In FIG. 3 there is shown a first embodiment of the invention. An end plate 30 is provided with a port 31 extending through the plate and forming one of the ports in the same. The side surface 36 of the end plate 30 is unmachined round the port 31. The port is covered by a cover 32 which comprises two parts 33 nd 35. The first part 33 is a thin plate, which can be arranged between the end plate 30 and an adjacent heat exchange plate 34. The second part 35 is relatively thick plate, which fills out essentially the entire port 31 radially. However, it is not necessary that the second part 35 extends through the whole end plate 30. THe first part 33 is too thin to withstand by itself the forces that a high internal pressure in the heat exchanger exerts against the same. However, since the two parts 33 and 35 are connected to each other, it is sufficient that the first part 33 is dimensioned to withstand shearing forces and the second part 35 dimensioned to withstand bending forces on against the cover 32 as a result of the internal pressure in the plate heat exchanger.

In FIG. 4 there is shown another embodiment of a cover 40 which comprises two parts 41 and 43. The first part 41, which is formed as a cylindric pot with an edge flange 42, is intended to be placed in the port and essentially fill out the latter radially, while said edge flange 42 is intended to lie between the one side surface an an adjacent heat exchange plate. The second part 43 consists of a relatively thick plate which is placed in and joined with the first part 41. Further, the second part 43 is formed so that its side facing the adjacent heat exchange plate lies at about the same level as the edge flange 42. Hereby a stable cover 40 is achieved, which covers the port and which can withstand the forces caused by the internal pressure in the heat exchanger.

In FIG. 5 there is shown a third embodiment of a cover 50 which is made in only one piece, a first part 51 of the cover 50 being intended to lie between a side surface of an end plate and an adjacent heat exchange plate, and a second part 52 being intended to be arranged in the port to essentially fill out it radially. The cover 50 may be machined starting from a solid piece of plate, or be manufactured by some other known method.

In FIG. 6 there is shown a fourth embodiment of a cover 60 consisting of two parts 61 and 63. The first part 61 is formed as a hollow cylinder having an edge flange 62. The cylindrical portion is intended to be arranged in a port and lie close to he wall of the port, while the edge flange 62 is intended to lie between one side surface of an unmachined end plate and an adjacent heat exchange plate. The cylindrical portion with the edge flange is preferably formed by plastic machining of a thin plane plate. A thicks econdn part 63 is intended to cooperate with the first part 61 to cover the hole in the cylindrical portion and, therefore, has to be sealingly fixed to the first part 61. The second part 63 is arranged within the cylindrical portion, the side of the second part 63, which faces the heat exchange plates, being at about the same level as the edge flange 62.

The two parts of the proposed covers can be fixed to each other for example by welding, soldering or glueing, but also other joining methods may be suitable. The first thin part preferably extends essentially around the port, even if other embodiments would be possible, for example in the form of several projections fixed to the thicker second part and abutting against the side surface of said end plate. The cover is preferably firmly held with its first part clamped between said side surface of the end plate and an adjacent heat exchange plate.

We claim:

1. Plate heat exchanger comprising several heat exchange plates arranged between two end plates (30), at least one of which has through-ports (31) and a side surface (36) facing against the heat exchange plates, and being unmachined around the ports (31), at least one of said ports (31) being provided with a cover (32, 40, 50, 60) preventing through-flow, characterized in that said cover (32, 40, 50, 60) is applied against the side surface (36) of the end plate (30) facing the heat exchange plate, and comprises at least two cooperating parts, a first thin part (33, 41, 51, 61) abutting said side surface (36) and a second thick part (35, 43, 52, 63) mainly placed within and essentially covering said port (31), said first part (33, 41, 51, 61) being dimensioned to withstand shearing forces, and said second part (35, 43, 52, 63) being dimensioned to withstand bending forces acting on the cover (32, 40, 50, 60) as a result of an internal pressure in the plate heat exchanger.

2. Plate heat exchanger according to claim 1, characterized in that said first part (33, 41, 51, 61) extends essentially around the port (31).

3. Plate heat exchanger according to claim 1 or 2, characterized in that the cover (32, 40, 50, 60) with its first part (33, 41, 51, 61) is firmly held between said side surface (36) and an adjacent heat exchange plate (34). (36) and an adjacent heat exchange plate (34).

* * * * *

UNITED STATES PATENT AND TRADEMARK OFFICE

CERTIFICATE OF CORRECTION

PATENT NO. : 4,871,013

DATED : October 3, 1989

INVENTOR(S) : Nilsson et al.

It is certified that error appears in the above-identified patent and that said Letters Patent is hereby corrected as shown below:

Col. 1, line 9 space missing between being & unmachined
line 10 change "oen" to "one"

line 53 change "dimensioed" to "dimensioned"

Col. 2, line 16 change "reltively" to "relatively"
line 19 add "the" after "bending of"

line 34 change "prssure" to "pressure"
line 40 change "nd" to "and"
line 43 add "a" after "35 is"
line 46 change "THe" to "The"
line 60 change "surface an" to "surface and"

Col. 3, line 14 change "he" to "the"
line 19 change "thicks econdn" to "thick second"

Col. 4, line 30 delete entire line.

Signed and Sealed this

Eleventh Day of September, 1990

*Attest:*

HARRY F. MANBECK, JR.

*Attesting Officer*

*Commissioner of Patents and Trademarks*